US006266024B1

(12) United States Patent
Ramanujam et al.

(10) Patent No.: US 6,266,024 B1
(45) Date of Patent: Jul. 24, 2001

(54) ROTATABLE AND SCANNABLE RECONFIGURABLE SHAPED REFLECTOR WITH A MOVABLE FEED SYSTEM

(75) Inventors: Parthasarathy Ramanujam, Redondo Beach; Brian M. Park, Torrance; Louis R. Fermelia, Redondo Beach; Vincent E. Cascia, Manhattan Beach, all of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/222,420

(22) Filed: Dec. 23, 1998

(51) Int. Cl.[7] ..... H01Q 13/00

(52) U.S. Cl. ..... 343/781 CA; 343/757; 343/761; 343/781 P

(58) Field of Search ..... 343/757, 765, 343/761, 779, 786, 781 CA, 781 P, 781 R, 836, 837, 878, 880, 882

(56) References Cited

U.S. PATENT DOCUMENTS

| | | | | |
|---|---|---|---|---|
| 4,425,566 | * | 1/1984 | Dragone | 343/781 P |
| 4,535,338 | * | 8/1985 | Ohm | 343/781 CA |
| 4,618,867 | * | 10/1986 | Gans | 343/781 P |
| 4,933,681 | | 6/1990 | Estang | 343/765 |
| 5,796,370 | * | 8/1998 | Courtonne et al. | 343/781 |
| 6,043,788 | * | 3/2000 | Seavey | 343/781 CA |

FOREIGN PATENT DOCUMENTS

0918367 A2 5/1999 (EP) .

OTHER PUBLICATIONS

"In–orbit reconfigurable communications–satellite antennas," J.F. Balcewicz, *RCA Engineer* 28–2, Mar./Apr. 1983, pp 36–41.

"The L–Band Land Mobile Payload (LLM) Aboard Artemis," L. Micracapillo et al, *American Institute of Aeronautics and Astronautics*, 96–1086–CP, pp 879–887.

"Reconfigurable satellite antennas: a review," F. Rispoli, *Microwave and RF Engineering*, Apr. 1989, pp S22–S27.

"Recent Developments in Reconfigurable Reflectors," P.J.B. Clarricoats et al, *IEEE*, 90C112776–3XXX–1864 S1.(x) 1990, pp. 1864–1867.

"A Novel Semi–Active Multibeam Antenna Concept," A. Roederer et al, *IEEE*, 90C112776–3XXX–1884 (x), 1990, pp 1884–1887.

"Inmarsat's Third Generation Space Segment," A. Howell et al, *American Institute of Aeronautics and Astronautics*, Inc., 92–1815–CP, pp 92–99.

"Active Ku–Band Spaceborne Antennas: Design, Technology and Testing," D. Michel et al, Alcatel Telecom, pp 341–347.

"Active Antennas for Multiple–Beam Communications Satellites: Status and Review," A.I. Zaghloul et al, COMSAT Labs, Clarksburg, MD 20871, pp 319–338.

"A Design Method of a Reconfigurable Direct Radiating Array Antenna," T. Morooka et al, *IEICE Trans. Commun.*, vol. E77–B, No. 5, May 1994, pp 663–672.

"Resolution Performance of Adaptive Multiple Beam Antennas," K.M. SooHoo et al, Electronics Reserch Laboratory, The Aerospace Corporation.

"Reconfigurable Dual Feed Antenna for Direct Broadcast Satellites," N. Sultan et al, pp 27–35.

"The IRIDUM ® Main Mission Antenna Concept," J.J. Schuss et al, *IEEE* 0–7803–3232–6/96, pp 411–415.

"Anaren Low Cost, Lightweight Antenna Beamforming Networks," An Anaren Technical Publication M 1090–49, Aug. 11, 1994, pp 1–12.

"Multiple–Beam Antennas for Military Satellite Communications," J.J. Tavormina, *MSN & CT*, Oct. 1988, pp 20–24.

"Building on a Powerful Thought," Electromagnetic Sciences, Inc., *MSN & CT*, Oct. 1988, pp 2930.

"The Eutelsat II reconfigurable multibeam antennas: development review," G. Duret et al, *Ann. Telecommun.*, 44, No. 9–10, 1989, pp 501–513.

* cited by examiner

*Primary Examiner*—T. Phan
(74) *Attorney, Agent, or Firm*—T. Gudmestad

(57) ABSTRACT

An antenna system having a rotatable and scannable reconfigurable shaped reflector with a movable feed system. The antenna system allows beam shapes to be rotated about an optimum axis and defocused while a spacecraft is in orbit in order to change a particular coverage pattern for the spacecraft.

7 Claims, 6 Drawing Sheets

| | | |
|---|---|---|
| AOR | USMEX | UNITED STATES AND MEXICO |
| | NSA | NORTHERN SOUTH AMERICA |
| | SSA | SOUTHERN SOUTH AMERICA |
| | EUR | EUROPE |

| | | |
|---|---|---|
| IOR | EME | EUROPE AND MID EAST |
| | IND | INDIA |
| | ASIA | ASIA |
| | SAF | SOUTH AFRICA |

| | | |
|---|---|---|
| POR | NEA | NORTHEAST ASIA |
| | SEA | SOUTHEAST ASIA |
| | AUST | AUSTRALIA |
| | US | UNITED STATES |

ROTATABLE AND SCANNABLE RECONFIGURABLE SHAPED REFLECTOR WITH A MOVABLE FEED SYSTEM

CROSS-REFERENCE TO RELATED APPLICATIONS

This application is related to co-pending U.S. patent application Ser. No. 09/222,419, entitled "Reconfigurable Satellite and Antenna Coverage Communications Backup Capabilities" filed simultaneously with the present application, the subject matter of such co-pending application being incorporated herein by reference.

TECHNICAL FIELD

The present invention relates to space and communications antennas. More particularly, the present invention relates to a rotatable and scannable reconfigurable shaped reflector with a movable feed system.

BACKGROUND ART

It is typical to customize a satellite for a particular country or geographic area based on a given orbital location of the satellite. This limits the satellite to use only for that specific application. If a situation arises where it becomes necessary to change geographic areas, a newly configured satellite must be launched in order to effect change.

In the case of a malfunction of a satellite, another satellite must be built to a similar performance specification. This can result in a delay of up to three years, for the build and launch of the replacement satellite. A reconfigurable antenna system would alleviate some of the drawbacks associated with area specific satellite systems.

There are complex approaches to achieving efficient reconfigurable antennas. However, these approaches have limited efficiency due to current amplifier designs. While in the future this approach may be possible with better amplifier designs, it is not yet practical to employ active antennas.

A rotatable antenna beam may be accomplished by rotating a subreflector in a Gregorian dual reflector. The subreflector is initially shaped to generate a simple elliptic beam. However, the beam size is limited to about 3 to 4 degrees, since the subreflector shaping is limited in its capabilities. This is a disadvantage because many current day C-band beams are very large. Another drawback is that subreflector shaping limits the beam shapes to simple shapes, and most applications require complex beam shape capability.

SUMMARY OF THE INVENTION

The present invention is an antenna system that provides efficient beam reconfiguration without the drawbacks associated with known technology. The antenna system of the present invention has at least one antenna that can be reconfigured to operate for a large coverage area and allows complex beam shape capability.

The antenna system of the present invention has a main reflector shape that is initially optimized for a predetermined radiation pattern or beam shape. From the optimized radiation pattern, an optimum axis is determined. A rotating and gimbaling mechanism is located on the optimum axis to allow beam rotation and gimbaling about the optimum axis. The optimum axis is used because it allows the beam to rotate without changing its shape. The beam position does not change as it is rotated about the optimum axis. Therefore the beam position does not change. The beam can be rotated without distorting the beam shape.

It is an object of the present invention to provide a low cost, high efficiency reconfigurable antenna. It is another object of the present invention to provide a reconfigurable antenna that is capable of producing very large, complex beam shapes.

It is still another object of the present invention to provide a reconfigurable antenna that will provide flexibility to satellite coverage patterns making it possible to alter a satellite's coverage area.

Other objects and features of the present invention will become apparent when viewed in light of the detailed description of the preferred embodiment when taken in conjunction with the attached drawings and appended claims.

BEST MODE(S) FOR CARRYING OUR THE INVENTION

Figure 1:
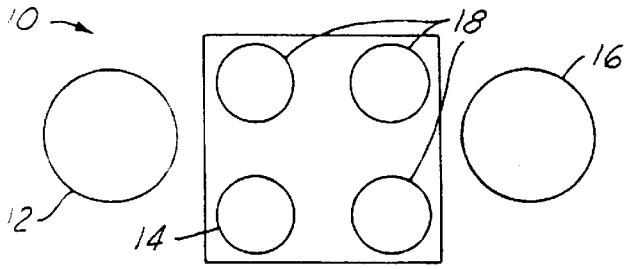
FIG. 1 is a preferred embodiment of an antenna system of the present invention.

Referring to FIGS. 1 through 11, and in particular to FIG. 1, there is shown an antenna system 10 of the present invention. The antenna system includes six (6) antennas of Gregorian dual-reflector configuration. While the preferred embodiment of the invention is being described herein in terms of a dual-reflector configuration, it should be noted that a single reflector configuration illuminated by a movable feed and a rotatable reflector can be used as well.

Two of the antennas of the present example operate at C-band frequencies and four of the antennas operate at Ku-band frequencies. Specifically the antenna system 10 includes a large C-band antenna 12, a smaller C-band antenna 14, one large Ku-band antenna 16, and three (3) smaller Ku-band antennas 18. All of the antennas operate over two orthogonal linear polarizations and transmit and receive bands. The main reflectors of all of the antennas are fitted with rotatable and gimbaling mechanisms that allow for rotation and scanning of the beams. The Ku-band feeds can be axially defocused to facilitate beam shape variation in orbit. It is also possible to defocus the C-band feeds. However, in most cases, it is not necessary to defocus the C-band feed because the large size of the beam shape does not require beam shape variation. In instances where it is desirable, the C-band beam shape can be varied by defocusing the feed or by moving the subreflector.

All of the antennas are fed by high performance corrugated horn feeds (not shown in FIG. 1, see 28 in FIGS. 3A and 3B and 34 in FIGS. 9A and 9B) that are characterized by superior spillover and cross-polarization performance. Because of the cross-polarization characteristics of the Gregorian configuration, a single feed can be used for both polarizations. The system 10 of six (6) antennas generates different beams covering areas of three ocean regions; Atlantic Ocean Region 11 (AOR, shown in FIG. 2A), Indian Ocean Region 13 (IOR, shown in FIG. 2B), and Pacific Ocean Region 15 (POR, shown in FIG. 2C).

Figure 3A:
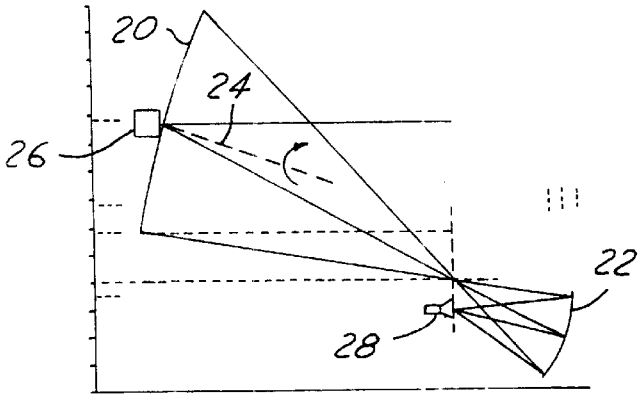
FIG. 3 is the C-band dual reflector geometry.
Figure 3B:
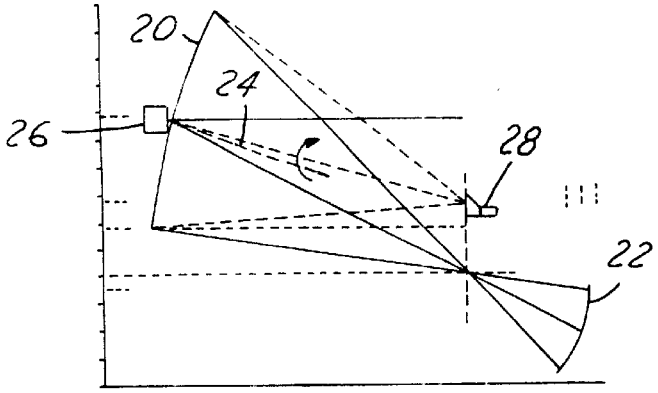

FIG. 3A is a diagram of a C-band dual-reflector geometry, a main reflector 20 and a subreflector 22 are shown. An optimum axis 24 is determined, and a rotating and gimbaling mechanism 26 is located on the optimum axis 22 to allow rotation of the beam shape. An antenna feed 28 is located on the subreflector 22. In an alternate embodiment, the antenna feed 28 may be located on the main reflector 20.

Figure 4:
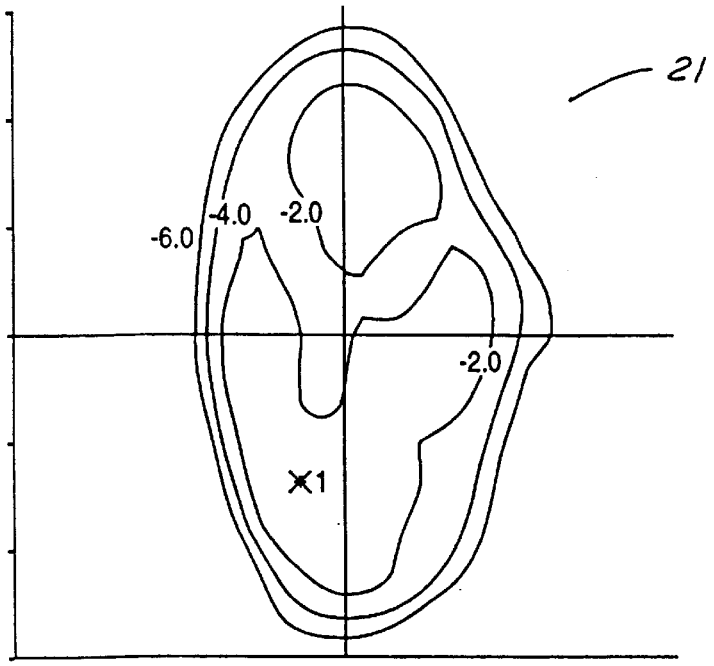
FIG. 4 is the nominal C-band coverage pattern.

Each of the main reflectors 20 is shaped to a nominal beam shape. The nominal beam shape and main reflector shape are chosen after examining the antenna beams specific to the satellite system to be employing the reconfigurable antenna system 10. In the present example, an elliptical beam 21 is shown. FIG. 4 is the nominal C-band coverage for the antenna shown in FIG. 3 antennas shown in FIGS. 3A and 3B.

Figure 5:
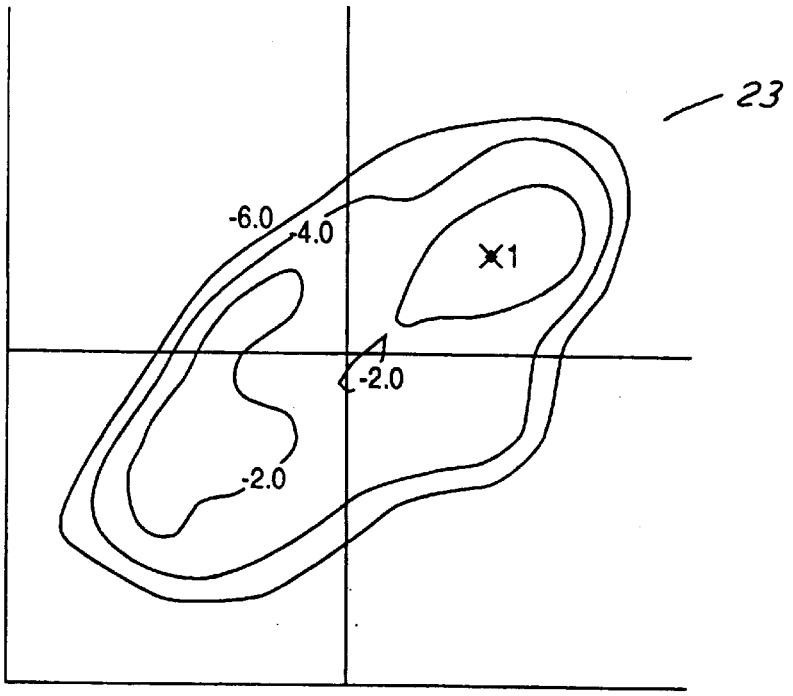
FIG. 5 is the C-band coverage rotated by 45 degrees.
Figure 6:
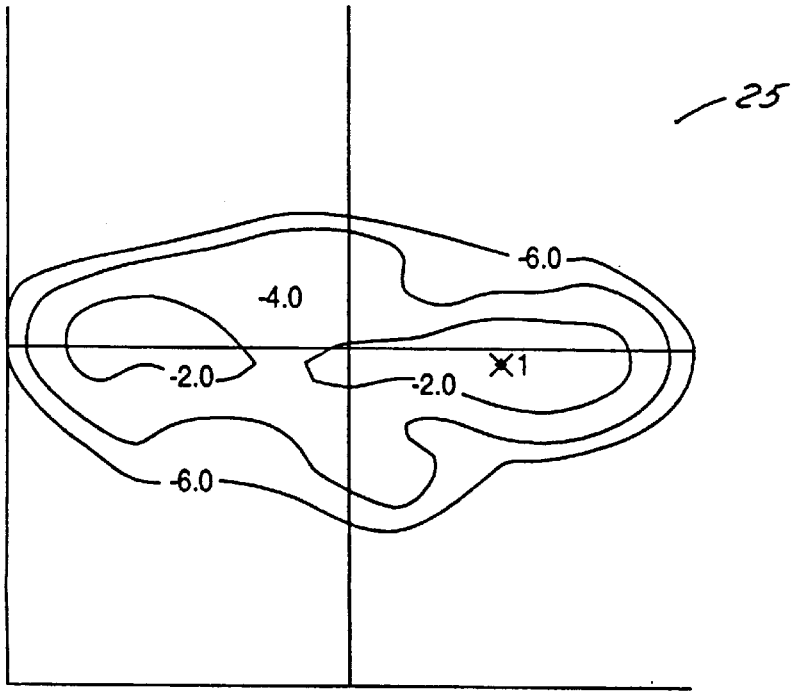
FIG. 6 is the C-band coverage pattern rotated by 90 degrees.
Figure 7:
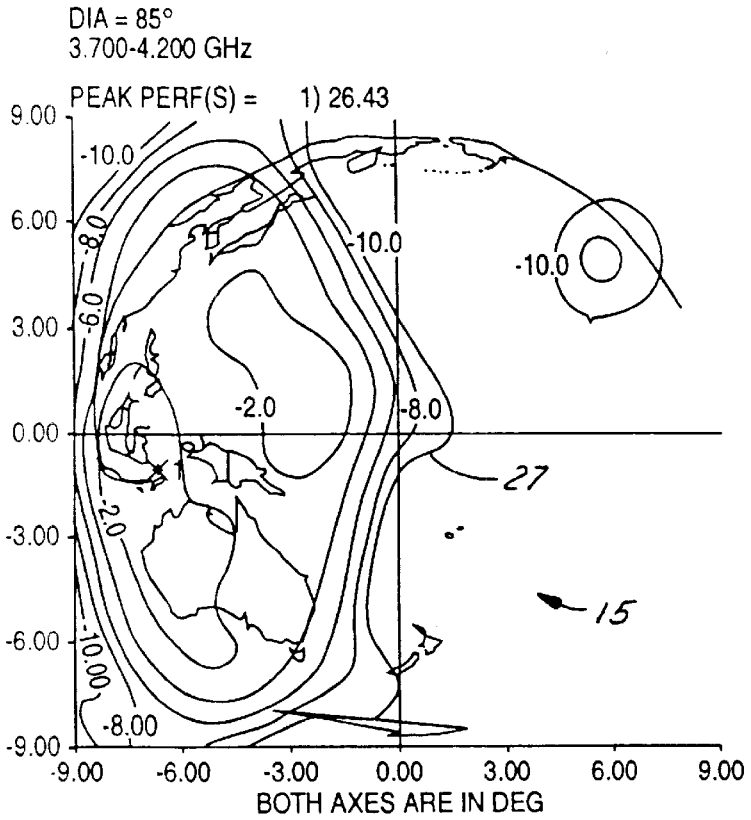
FIG. 7 is the reconfigured C-band coverage beam over the Pacific Ocean Region.
Figure 8:
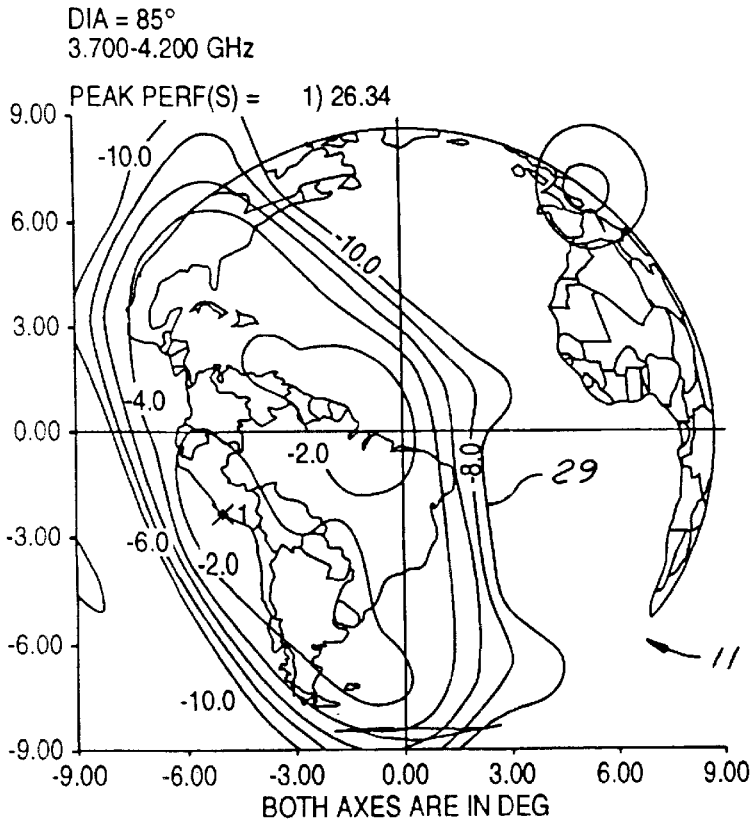
FIG. 8 is the reconfigured C-band coverage beam over the Atlantic Ocean Region.

Rotating the main reflector 20 allows the beam shape to be rotated. The beam can be rotated about the optimum axis 24 without scanning. The beam position does not change as it is rotated about the optimum axis 24. Therefore, the beam can be rotated with only minimal distortion of its shape. FIG. 5 shows the elliptical beam shape 23 rotated 45 degrees and FIG. 6 shows the elliptical beam shape 25 rotated 90 degrees. The rotated beam shape can be scanned over different regions of Earth by the gimbaling mechanism 26 on the main reflector 20. FIG. 7 shows the reconfigured C-band beam shape 27 over the Pacific Ocean Region 15. FIG. 8 shows the reconfigured C-band beam shape 29 over the Atlantic Ocean Region 11.

Figure 9A:
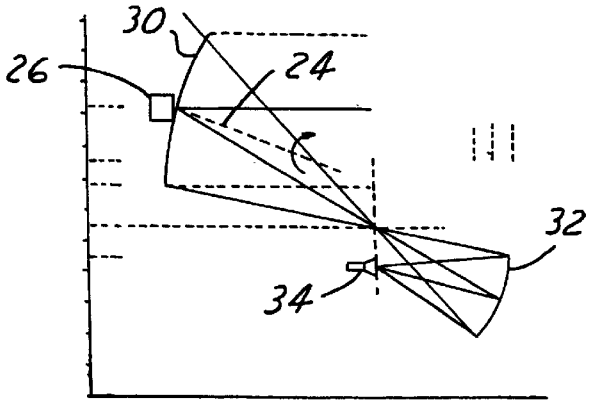
FIG. 9 is the Ku-band dual reflector geometry.
Figure 9B:
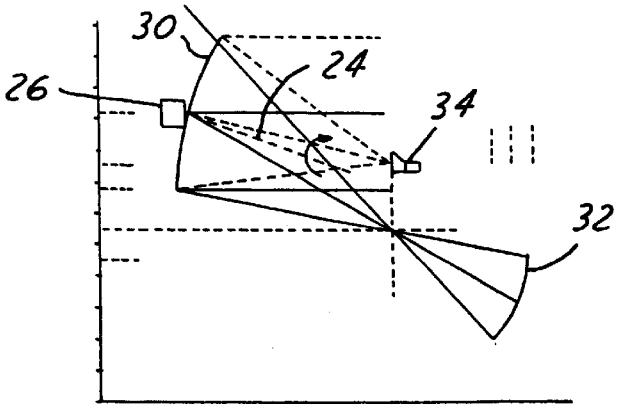

The Ku-band reflector geometry is shown in FIG. 9A. The Ku-band antenna in the present example has a main reflector 30 and a subreflector 32. At Ku-band frequencies additional beam shape variations can be obtained by using axial movements of the antenna feed 34. Axial movement may be limited by the antenna geometry. In the present example, the Gregorian geometry limits the axial movement to six (6) inches on either side of the antenna's focus.

Figure 11:
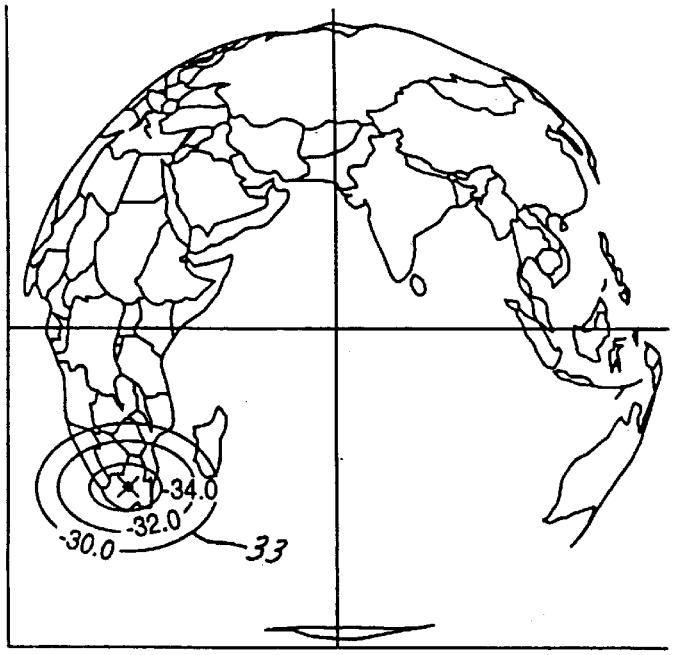
FIG. 11 is the Ku-band coverage pattern with improved gain over South Africa.
Figure 10:
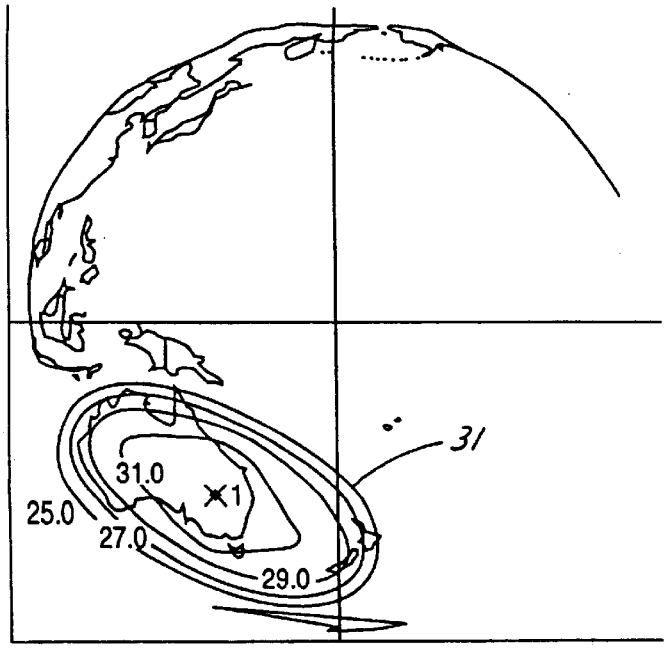
FIG. 10 is the nominal Ku-band coverage pattern over Australia.

In the present example, the nominal shape of the Ku-band antenna beam is optimized for Australia and New Zealand by scanning the shaped beam. The scanned beam shape 31 is shown in FIG. 10. The antenna feed 34 can be defocused thereby reducing the size of the beam shape 33 so that it can be used over South Africa as shown in FIG. 11. A similar beam shape change can be obtained by maintaining the feed on the main reflector and moving the subreflector 32 only (see FIG. 9B). It is also possible to defocus the C-band antenna beam as well. However, because of the C-band antenna beam shape's large size, this is usually not necessary.

The diameter, focal length and offset of the antenna geometry are chosen to obtain optimum performance in terms of rotation and scanning of the beam. The dimensions of the subreflectors 32 are chosen to minimize the diffraction losses.

In the preferred embodiment all of the antennas have Gregorian geometry. All of the main reflectors 20, 30 are single-surface shaped graphite reflectors. This type of reflector is exceptionally stable thermally and has little susceptibility to distortion in manufacturing. All of the reflectors 20, 22, 30, 32 are center mounted to the antenna structure. All of the main reflectors 20, 30 are deployed and utilize pointing mechanisms that allow steering in all three axes.

As explained above, it is possible to use a single reflector that is capable of producing beams that can be arbitrarily rotated and scanned over a wide angular region. The single reflector (not shown) is illuminated by a feed, and by rotating the reflector about an optimum axis, the beam is rotated without altering the beam shape. Additionally, the single reflector can be gimbaled in two axes to scan the beam to any far-field direction. In the single reflector configuration, the beam size can be altered by axially moving the feed.

In the preferred embodiment, the dual-reflector antennas 12, 14, 16, 18 are structurally attached to a unified antenna structure (not shown). The nadir (earth facing) antennas are mounted to the nadir panel (not shown) of the unified antenna structure. The east and west antennas are mounted to the nadir panel by way of graphite booms and feed panels (not shown). The nadir panel of the unified antenna structure is kinematically mounted to the spacecraft (not shown) subnadir shelf (not shown) by way of a three-bipod system (not shown). This mounting system allows the entire antenna to be thermally decoupled from the rest of the spacecraft (not shown) The unified antenna structure proper is a thermally stable platform whose stability minimizes diurnal distortions between antenna beams. The C-band feeds 26 are hard mounted to the unified antenna structure by way of match drilled brackets (not shown). The Ku-band feeds 32 can be mechanically defocused several inches in both directions using flight proven linear actuators (not shown).

Figure 2A:
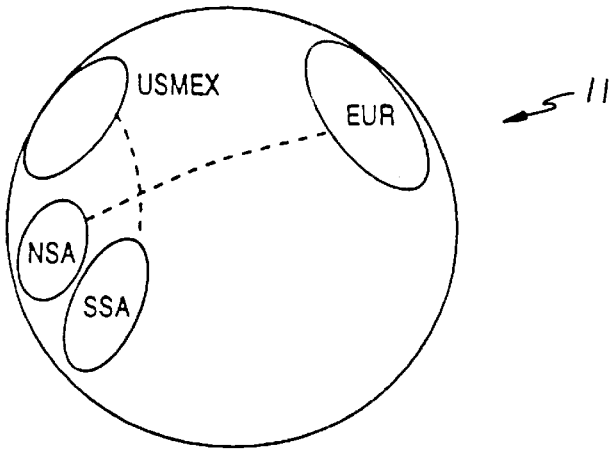
FIG. 2A depicts the Atlantic Ocean Region.
Figure 2B:
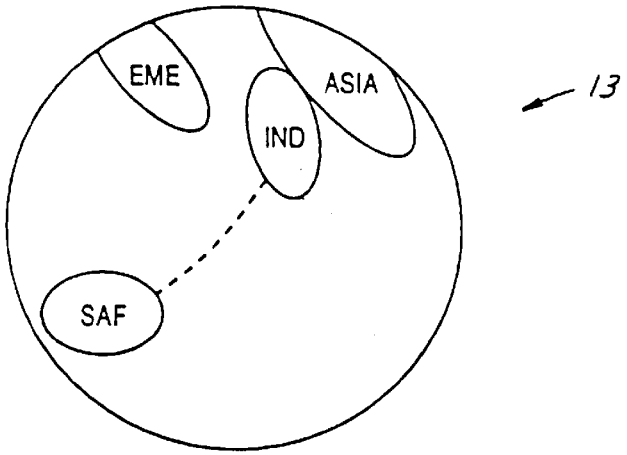
FIG. 2B depicts the Indian Ocean Region.
Figure 2C:
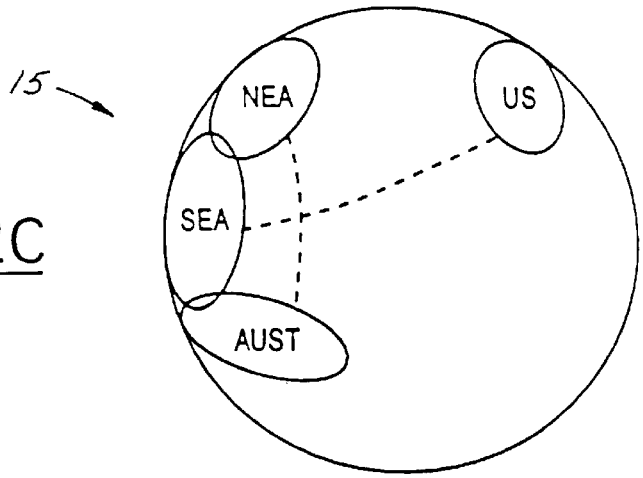
FIG. 2C depicts the Pacific Ocean Region.

The antenna system 10 of the present invention generates C-band and Ku-band beams to cover as many different areas as possible. In the preferred embodiment, the antenna system 10 covers as many as six different satellite configurations over three ocean regions. The antennas are optimized for performance in terms of beam shape and the frequencies associated with each beam. Each antenna is assigned a particular beam in a given orbital location as shown in FIGS. 2A through 2C. Therefore, the main reflector rotation about the optimum axis, the main reflector gimbaling, and the feed defocusing are optimized for each antenna to obtain optimum beam shape.

The rotatable beam shapes and the defocusable reflectors provide a variety of complex beam shapes that can be combined with the rotatable beam shapes of the other antennas in the antenna system 10 to alter beam shapes allowing antenna coverage of several different areas. There is no longer a need to build and launch a satellite having particular coverage specifications if business needs change. A satellite employing the flexible antenna system of the present invention is capable of providing back up flexibility and a change in coverage patterns while in orbit.

While particular embodiments of the invention have been shown and described, numerous variations and alternate embodiments will occur to those skilled in the art. Accordingly, it is intended that the invention be limited only in terms of the appended claims.

What is claimed is:

1. A reconfigurable antenna system for reconfiguring a beam shape, said reconfigurable antenna system comprising:

at least one main reflector having an optimum axis;

at least one subreflector;

a rotating mechanism on said at least one main reflector for rotating a beam about said optimum axis;

a gimbaling mechanism on said at least one main reflector for scanning said beam;

an antenna feed on said at least one subreflector, wherein said antenna feed comprises means for defocusing said feed in order to accommodate beam shape variation;

whereby said beam shape can be rotated about said optimum axis and scanned for beam shape variation.

2. The antenna system as claimed in claim 1 further comprising a large C-band antenna, a small C-band antenna, a large Ku-band antenna, and three small Ku-band antennas.

3. The antenna system as claimed in claim 2 wherein said antenna feeds for said Ku-band antennas further comprise means for defocusing said feed in order to accommodate beam shape variation.

4. The reconfigurable antenna system as claimed in claim 1 wherein said antenna feed further comprises a high performance corrugated horn feed.

5. The reconfigurable antenna system as claimed in claim 1 wherein said at least one main reflector and said at least one subreflector further comprise Gregorian configuration.

6. A reconfigurable antenna system for reconfiguring a beam shape, said reconfigurable antenna system comprising:

at least one main reflector having an optimum axis;

at least one subreflector;

a rotating mechanism on said at least one main reflector for rotating a beam about said optimum axis;

a gimbaling mechanism on said at least one main reflector for scanning said beam;

an antenna feed on said at least one main reflector;

whereby said beam shape can be rotated about said optimum axis and scanned for beam shape variation; and wherein said beam shape is varied by moving said subreflector.

7. A reconfigurable antenna system comprising:

a reflector;

means for rotating said reflector about an optimum axis;

means for gimbaling said reflector;

means for illuminating said reflector; and means for axially moving said means for illuminating said reflector.

* * * * *